US006109787A

United States Patent [19]

Stary

[11] Patent Number: 6,109,787

[45] **Date of Patent: *Aug. 29, 2000**

[54] SOFT BAG FOR PERSONAL-HYGIENE ARTICLES

[75] Inventor: Christof Karl Stary, Eckental, Germany

[73] Assignee: Procter & Gamble, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/051,389

[22] PCT Filed: Oct. 15, 1996

[86] PCT No.: PCT/US96/16426

§ 371 Date: Jul. 27, 1998

§ 102(e) Date: Jul. 27, 1998

[87] PCT Pub. No.: WO97/13697

PCT Pub. Date: Apr. 17, 1997

[30] Foreign Application Priority Data

Oct. 13, 1995 [EP] European Pat. Off. ..... 95116136

[51] Int. Cl.[7] ..... B65D 33/36

[52] U.S. Cl. ..... 383/209; 383/41; 383/66; 383/67; 221/45; 221/63

[58] Field of Search ..... 383/209, 207, 383/67, 66, 41; 221/45, 63, 64, 65, 282, 283, 302

[56] References Cited

U.S. PATENT DOCUMENTS

| | | | |
|---|---|---|---|
| 546,849 | 9/1895 | Hughes | 221/45 |
| 1,890,295 | 12/1932 | Jacobs . | |
| 2,448,819 | 9/1948 | Mitchell | 221/63 |
| 3,095,088 | 6/1963 | Blaikie et al. . | |
| 3,161,336 | 12/1964 | Loescher | 221/63 |
| 4,883,675 | 11/1989 | Wernz | 383/209 X |
| 4,927,064 | 5/1990 | Burgin . | |
| 4,966,286 | 10/1990 | Muckenfuhs . | |
| 5,163,558 | 11/1992 | Palumbo et al. . | |
| 5,685,643 | 11/1997 | Stary | 383/209 X |
| 5,704,714 | 1/1998 | Stary | 383/67 |

FOREIGN PATENT DOCUMENTS

| | | | |
|---|---|---|---|
| 2017599 | 5/1970 | France . | |
| 4214649 | 11/1993 | Germany | 383/120 |
| WO 93/16929 | 9/1993 | WIPO . | |
| WO 94/19249 | 9/1994 | WIPO . | |
| WO 94/27889 | 12/1994 | WIPO . | |
| WO 97/13697 | 4/1997 | WIPO . | |

*Primary Examiner*—Jes F. Pascua
*Attorney, Agent, or Firm*—Vanessa M. Nichols

[57] ABSTRACT

A soft bag for accommodating a stack of personal-hygiene articles, especially of cosmetic cotton pads, which comprises a side wall, a bottom wall and removal mechanism, located in the bottom area of the bag, with a tear-off latch, defined by weakening lines in the bag wall. Two separate tear-off latches on two sides of the bottom area facing away from each other are provided in order to form two separate removal openings. The tear-off latches extend from the bottom wall into the side wall of the bag.

6 Claims, 2 Drawing Sheets

M
D
1
16
5
4
6
17
Z 2
17
15
2
Z 1
b

2
M
1
16
5
4
17
15
6
17
b
12
D

SOFT BAG FOR PERSONAL-HYGIENE ARTICLES

BACKGROUND OF THE INVENTION

1. Field of the Invention

The invention relates to a soft plastic bag for accomodating a stack of personal-hygiene articles, in particular of cosmetic cotton pads, comprising a substantially cylindrical side wall, a substantially circular bottom wall and a removal mechanism, located in the bottom area of the bag, with a removable tear-off latch defined by weakening lines in the bag wall.

2. Background Art

Soft bags of the generic type, which are produced in usual manner by doubling and welding a foil web made of e.g. polyethylene, comprise a substantially cylindrical side wall and a substantially circular bottom wall. The latter is formed by doubling and welding one end of a sheet-plastic tube which is an intermediate product of bag production.

A bag, prefabricated in this usual manner, is filled with a stack of personal-hygiene articles, such as the aforementioned circular cotton pads, the direction of stacking running parallel to the longitudinal axis of the bag. Afterwards, the bag is closed by a combined wield and string closure, as shown for example in WO-A-94/19249.

For the successive removal of the cotton pads, a removal mechanismn, formed substantially by a removable tear-off latch surrounded by weakening lines, is located in the bottom area of the bag.

The prior art teaches various configurations Thor the tear-off latch. Commonly, a circular tear-off latch is used, having a diameter slightly reduced in comparison to the diameter of the bottom wall, th position of the tear-off latch in the bottom wall being concentrical, which can also be seen in the above-mentioned WO-publication. In a hanging position of the bag—independently of its filling ratio—the bottom article of the remaining stack rests on the circular marginal edge which is left over from the bottom wall and can thus be grasped with the fingers from below. In this case, however, there is the disadvantage that the grasping of the bottom article is impeded by the fact that during this procedure the stack usually recedes into the inner part of the bag. This is often found annoying, especially if the bag is already emptied partially.

Furthermore, it is known from the prior art to provide a removal opening in the shape of a tearable slit located in the side wall of the bag at a short distance from the latter's bottom wall and running in a parallel direction to the edge of the bottom wall. Although the personal-hygiene articles in the bag can be grasped from the side and a receding of the stack is thus avoided, the removal of the article is yet complicated by the fact that the slit only forms a relatively narrow removal opening. Moreover, it is possible that the removal opening is directed towards the wall in the case of a soft bag hung by its string on a wall hook, so that for removal of a pad, the bag has to be turned around, which is rather inconvenient.

The above-mentioned disadvantage also applies to another known configuration of the removal opening, in which a single tear-off latch extends from the bottom wall into the side wall of the bag.

SUMMARY OF THE INVENTION

It is the object of the invention to further develop a soft bag of the generic type such that the convenience of handling the removal of an article is decisively improved.

In order to attain this object, it is provided according to the invention that two separate tear-off latches forming two separate removal openings are located on two sides of the bottom area of the bag facing away from each other in such a manner that the tear-off latches extend from the bottom wall into the respective side wall of the bag. By means of this arrangement, two large-surface removal openings facing away from each other are formed, so that the articles contained in the bag can be grasped and removed from two sides opposite of each other. For a bag hanging on a wall hook this means that one removal opening is always accessible either from the front or from the side, so that the bag, independently of its position, never has to be turned around before the removal of an article. By means of the removal openings extending into the side wall, the articles disposed there can easily be grasped from the side without the risk of the stack receding back into the bag, as mentioned above.

Preferred embodiments as well as further features, details and advantages of the soft bag according to the invention can be found in the following description of an embodiment referring to the attached drawings.

DESCRIPTION OF THE PREFERRED EMBODIMENT

Figure 1:
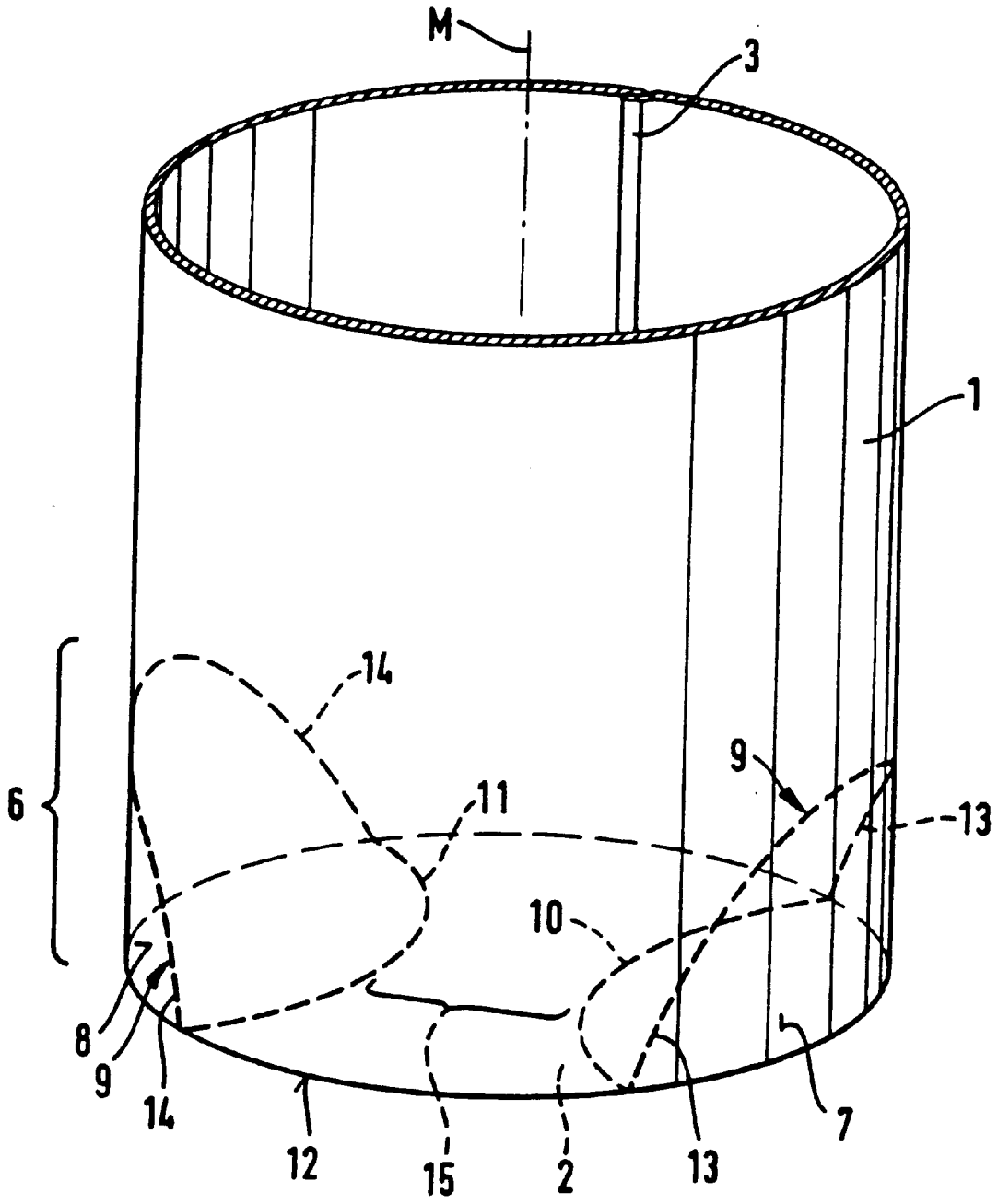
FIG. 1 is a partial perspective view of a soft bag.

As becomes obvious from the attached drawings, a soft bag according to the invention comprises a substantially cylindrical side wall 1 as well as a substantially circular bottom wall 2, both being formed in one piece out of a thin web of a polyethylene foil. During this procedure, the foil strip is doubled accordingly and welded together by means of a welding seam 3; thus a sheet-plastic tube is produced. The sheet-plastic tube again is cut to a certain length and formed by doubling and welding one end of the bottom wall 2. In the attached drawings, the doublings and welding seams, usually taking a relatively complex course, are left out for the sake of clarity. A combined weld and string closure is located in the head portion of the soft bag (not shown), as described in more detail in the above-mentioned WO-A-94/19249.

In order to form two removal openings 4, 5 in the bottom area 6 of the soft bag, two separate tear-off latches 7, 8 are provided, each being defined by perforated lines 9. As becomes obvious from FIG. 1, in which the contents of the bag are left out for the sake of clarity, the two tear-off latches 7, 8 are located on two sides of the bottom area 6 facing away from each other in such a manner that the tear-off latches 7, 8 extend from the bottom wall 2 into the side wall 1 of the bag.

Figure 2:
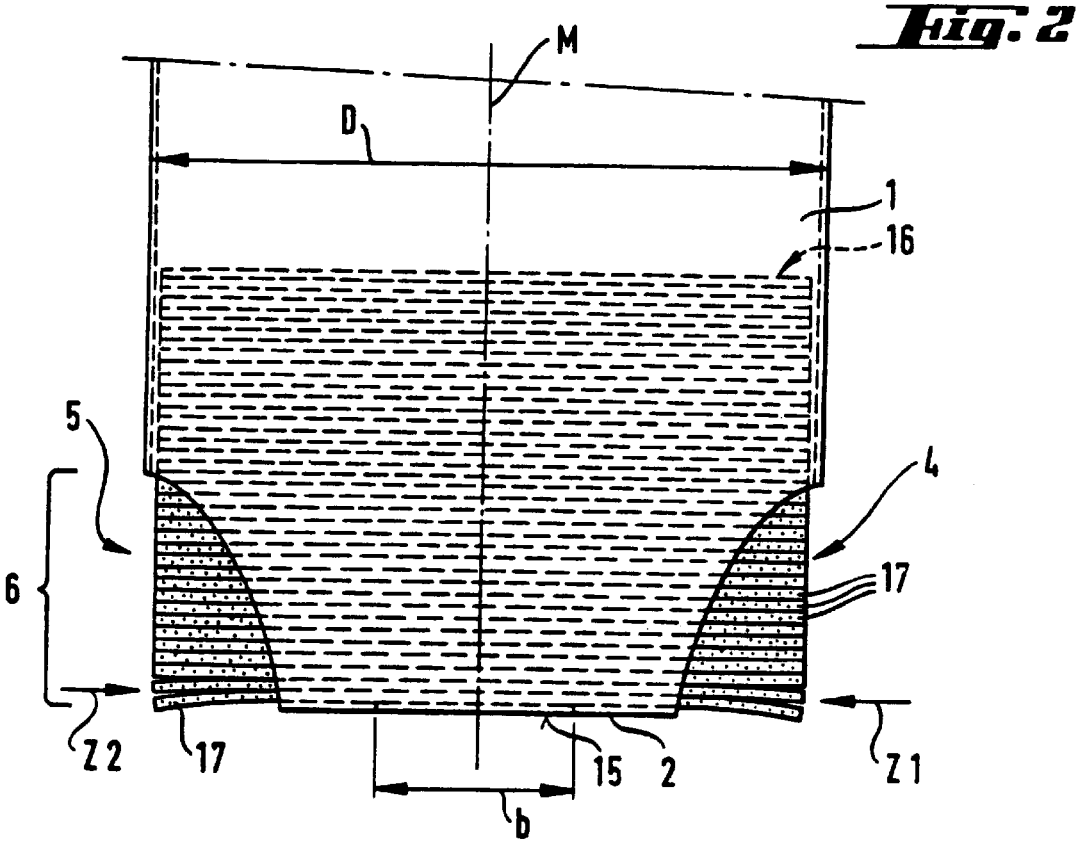
FIG. 2 is a partial side view of the bag with the tear-off latches removed.
Figure 3:
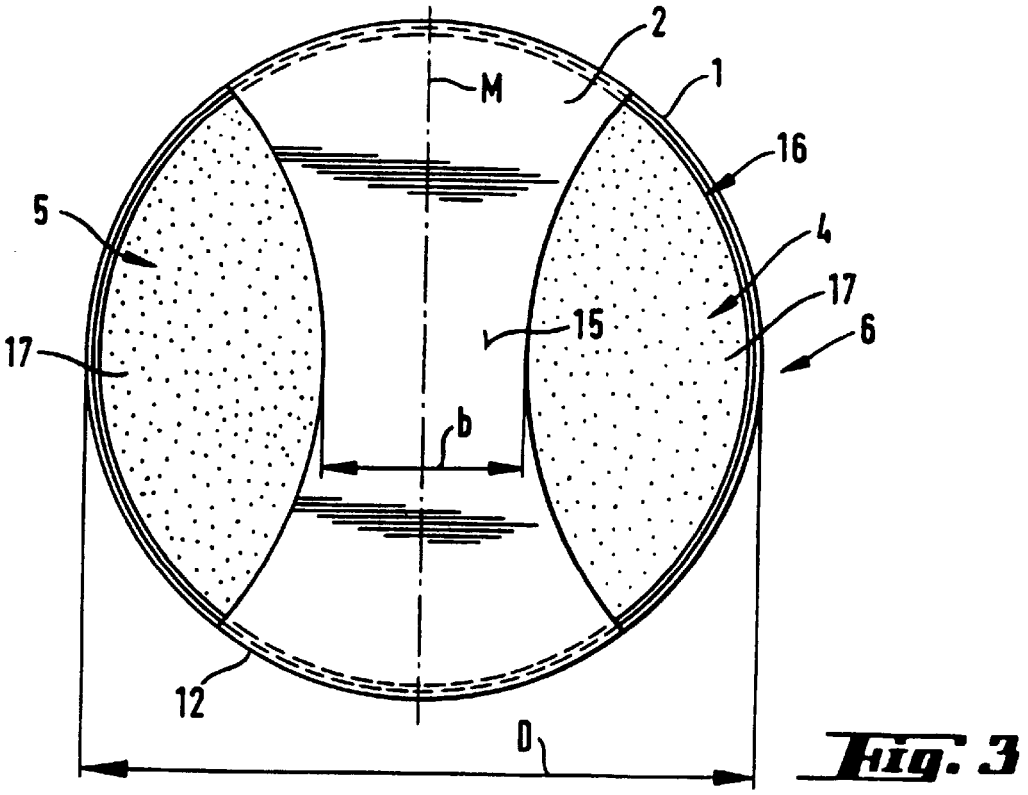
FIG. 3 is a bottom view of the soft bag according to FIG. 2.

As can be seen in FIGS. 1 and 3, the two legs 10, 11 of the perforated lines 9 running in the bottom wall 2 are formed as circular arcs curved in opposite direction to the circular lateral edge and disposed symmetrically to the central longitudinal plane M, the circular arcs continuing in the area of the lateral edge 12 as legs 13, 14 which also have the shape of circular arcs and are concave towards the bottom wall 2. This configuration of the perforated lines 9 produces a supporting rib 15 connecting the two opposed areas of the side wall 1, which supporting rib 15 is left over after the two tear-off latches 7, 8 have been removed and on which rests the stack 16 of circular cotton pads 17 (see FIGS. 2, 3) under the influence of gravity. In this case, the minimum width b of the supporting rib 15 is approximately equivalent to one third of the diameter D of the bottom wall 1. Besides, the two removal openings are formed symmetrically to the central longitudinal plane.

As becomes obvious from the two aforementioned drawings, the bottom cotton pads 17 of the stack 16 resting on the supporting rib 15 can easily be grasped from the side and pulled out of the bag from two directions of access Z1, Z2 facing away from each other.

What is claimed is:

1. A soft bag for accommodating a stack of personal-hygiene articles comprising a substantially cylindrical side wall, a substantially circular bottom wall and a removal mechanism, located in a bottom area of the bag, formed by two, separate and opposing removable tear-off latches, said tear-off latches are defined by weakening lines extending from the bottom wall into the side wall of the bag, wherein detachment of the tear-off latches along the weakening lines forms two separate openings for removal of the personal-hygiene articles.

2. A soft bag according to claim 1, wherein the weakening lines comprise a plurality of legs running in the side wall (1) and the bottom wall, respectively, and each being formed as circular arcs.

3. A soft bag according to claim 1, wherein after the removal of both tear-off latches (7, 8), a supporting rib of the bottom wall remains, connecting the two opposite side wall areas.

4. A soft bag according to claim 3, wherein a minimum width of the supporting rib is approximately equivalent to one third of a diameter of the bottom wall.

5. A soft bag according to claim 1, wherein the weakening lines are perforated lines.

6. A soft bag according to claim 1, wherein the two removal openings are arranged symmetrically to a central longitudinal plane of the soft bag.

* * * * *